US005664775A

United States Patent [19]

Kao

[11] Patent Number: 5,664,775

[45] Date of Patent: Sep. 9, 1997

[54] BALL-SHOOTING GAME MACHINE

[76] Inventor: Aqee Kao, No. 11, Alley 1, Lane 210, Chi-Chin-I Rd., Keelung City, Taiwan

[21] Appl. No.: 741,146

[22] Filed: Oct. 29, 1996

[51] Int. Cl.[6] ..... A63F 7/00

[52] U.S. Cl. ..... 273/121 B; 273/121 A; 273/118 A

[58] Field of Search ..... 273/121 R, 121 A, 273/121 B, 118 R, 118 A, 108, 119 R, 119 A

[56] References Cited

U.S. PATENT DOCUMENTS

| | | | |
|---|---|---|---|
| 3,825,265 | 7/1974 | Pitkanen et al. | 273/121 B X |
| 3,897,951 | 8/1975 | Morrison et al. | 273/121 A |
| 4,055,342 | 10/1977 | Matsumoto | 273/121 B X |
| 4,840,375 | 6/1989 | Lawlor et al. | 273/119 A X |
| 5,121,919 | 6/1992 | Martti | 273/118 A X |
| 5,149,095 | 9/1992 | Kashimoto et al. | 273/121 A X |
| 5,259,615 | 11/1993 | Lindstrom | 273/121 B |

*Primary Examiner*—Raleigh W. Chiu
*Attorney, Agent, or Firm*—Marshall & Melhorn

[57] ABSTRACT

A ball-shooting game machine includes a vertical game board having a front side with a vertical partition member mounted thereon for dividing the game board into a game zone and a ball guide zone. The partition member has a distal upper end which is spaced from an upper edge of the game board. A magnetic ball shooter is disposed behind the game board and includes a magnet disposed adjacent to the ball guide zone, and a drive assembly for moving the magnet between a first position adjacent to a lowermost portion of the ball guide zone, and a second position adjacent to an uppermost portion of the ball guide zone. When a metal game ball is in the ball guide zone, movement of the magnet from the first position to the second position will result in corresponding movement of the game ball from the lowermost portion to the uppermost portion of the ball guide zone. A pivotable guard plate is disposed at the upper end of the partition member, and enables the game ball to fall into the game zone when the magnet moves from the second position back to the first position.

10 Claims, 5 Drawing Sheets

BALL-SHOOTING GAME MACHINE

BACKGROUND OF THE INVENTION

1. Field of the Invention

The invention relates to a ball-shooting game machine, more particularly to a ball-shooting game machine with a magnetic ball shooter for shooting a metal game ball into a game zone of a game board.

2. Description of the Related Art

Ball-shooting game machines, such as pachinko machines, are commonly found in bowling alleys, movie theaters, and in amusement parlors. Conventional ball-shooting game machines employ a spring-loaded ball shooter for shooting a game ball into a game zone of a vertical game board. The game zone is provided with a plurality of deflection pins which interfere with movement of the game ball into scoring slots at the bottom end of the game zone.

It is noted that frequent use of the conventional ball-shooting game machine often results in fatigue of the spring-loaded ball shooter. Moreover, since the deflection pins are fixed to the game board, randomness of the game ball movement is relatively poor and depends primarily upon the biasing force that is applied by the spring-loaded ball shooter on the game ball.

SUMMARY OF THE INVENTION

The main object of the present invention is to provide a ball-shooting game machine which employs a magnetic ball shooter for shooting a metal game ball into a game zone of a game board, thereby obviating the drawbacks resulting from use of the spring-loaded ball shooter commonly installed in conventional ball-shooting game machines.

Another object of the present invention is to provide a ball-shooting game machine with moving deflection pins to enhance the randomness of the game ball movement.

According to this invention, a ball-shooting game machine comprises:

a vertical game board having a front side with a vertical partition member mounted thereon for dividing the game board into a game zone and a ball guide zone, the game board having upper and lower edges, the partition member having a distal upper end which is spaced from the upper edge of the game board;

a metal game ball disposed on the front side of the game board;

a magnetic ball shooter disposed behind the game board and including a magnet disposed adjacent to the ball guide zone, and a drive assembly for moving the magnet between a first position adjacent to a lowermost portion of the ball guide zone, and a second position adjacent to an uppermost portion of the ball guide zone, the magnet attracting magnetically with the game ball when the game ball is in the ball guide zone such that movement of the magnet from the first position to the second position will result in corresponding movement of the game ball from the lowermost portion to the uppermost portion of the ball guide zone; and a pivotable guard plate disposed at the upper end of the partition member, the guard plate having a pivot end mounted pivotally on the game board and a free end which extends horizontally into the ball guide zone, the game ball abutting against the guard plate and causing the guard plate to pivot upwardly when the game ball moves along with the magnet toward the uppermost portion of the ball guide zone, the guard plate preventing the game ball from returning into the game ball zone to cause separation of the game ball from the magnet and to permit the game ball to slide along the guard plate and fall into the game zone when the magnet is moved by the drive assembly from the second position back to the first position.

A rotary disk set is mounted rotatably on the front side of the game board in the game zone and includes a main rotary disk which is coupled to driving means and which has a rear side provided with a plurality of deflection pins that extend toward the game board for interfering with falling movement of the game ball in the game zone.

Preferably, the partition member has a distal lower end which is spaced from the lower edge of the game board. The front side of the game board is further provided with an elongated ball return guide which is disposed horizontally at the lower edge of the game board and which inclines downwardly from the game zone to the ball guide zone so as to guide the game ball from the game zone back to the ball guide zone via the lower end of the partition member. In addition, the game board is provided with a plurality of scoring slots disposed in the game zone between the ball return guide and the rotary disk set.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
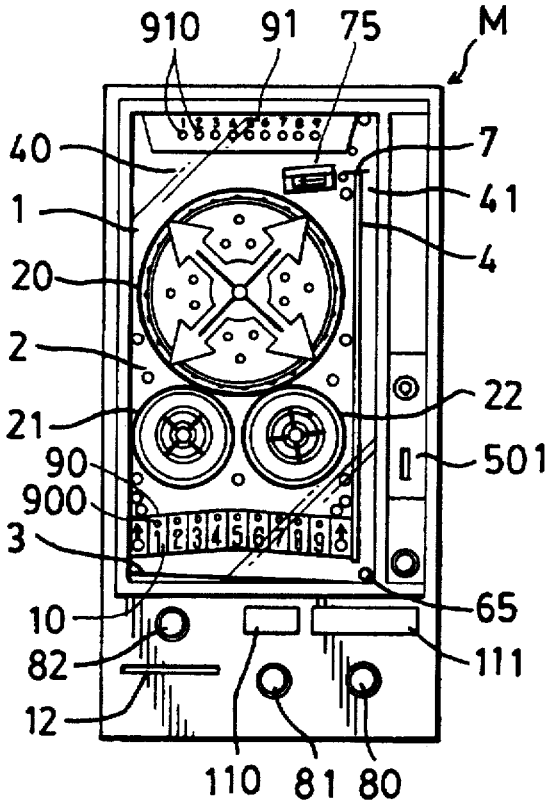
FIG. 1 is a schematic view of the first preferred embodiment of a ball-shooting game machine according to the present invention.

Referring to FIG. 1, the first preferred embodiment of a ball-shooting game machine according to the present invention is shown to comprise a machine frame (M) which is provided with a vertical game board 1 on an upper section thereof. The game board 1 has a front side with a vertical partition member 4 mounted thereon for dividing the game board 1 into a game zone 40 and a ball guide zone 41. The partition member 4 has distal upper and lower ends which are spaced from upper and lower edges of the game board 1.

An elongated ball return guide 3 is disposed horizontally on the front side of the game board 1 at the lower edge of the latter, and inclines downwardly from the game zone 40 to the ball guide zone 41. The ball return guide 3 guides a game ball 65 from the game zone 40 back to the ball guide zone 41 via the lower end of the partition member 4.

Figure 2:
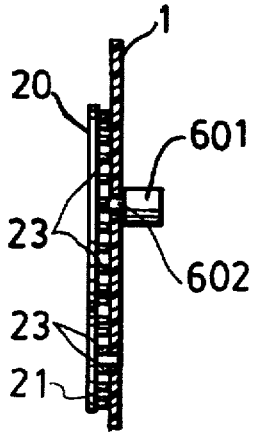
FIG. 2 is a sectional view illustrating a main rotary disk and a driven disk of the first preferred embodiment.

Referring to FIGS. 1 and 2, a rotary disk set 2 is mounted rotatably on the front side of the game board 1 in the game zone 40. As illustrated, the rotary disk set 2 includes a main rotary disk 20 and first and second driven disks 21, 22. A first bidirectional drive motor 601 is disposed on a rear side of the game board 1 and has a drive shaft 602 which extends through the game board 1. The main rotary disk 20 is mounted axially and securely on the drive shaft 602. Therefore, rotation of the drive shaft 602 results in corresponding rotation of the main rotary disk 20. In this embodiment, the first and second driven disks 21, 22 are disposed between the main rotary disk 20 and the ball return guide 3, and have peripheral edges which are in friction contact with the peripheral edge of the main rotary disk 20. Therefore, rotation of the main rotary disk 20 results in corresponding rotation of the first and second driven disks 21, 22. Each of the main rotary disk 20 and the first and second driven disks 21, 22 has a rear side provided with a plurality of deflection pins 23 that extend toward the game board 1. Thus, the deflection pins 23 move with the rotary disk set 2 relative to the game board 1. The deflection pins 23 interfere with falling movement of the game ball 65 through the rotary disk set 2 to the ball return guide 3, as will be described in greater detail hereinafter.

Figure 3:
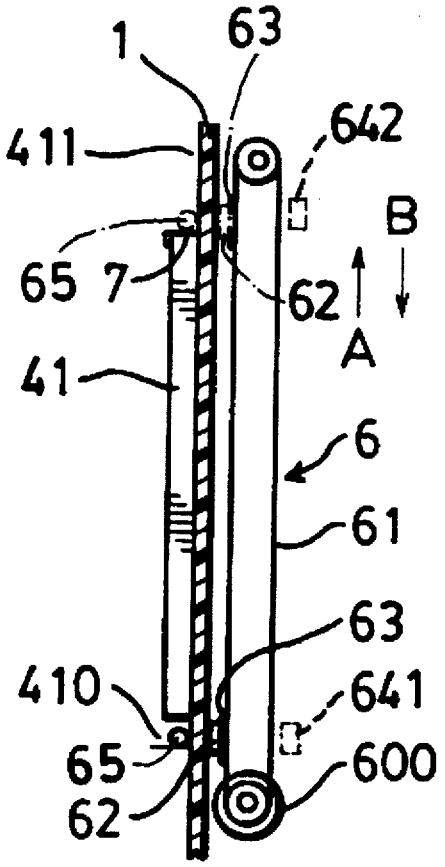
FIG. 3 is a sectional view illustrating a magnetic ball shooter of the first preferred embodiment.
Figure 4A:
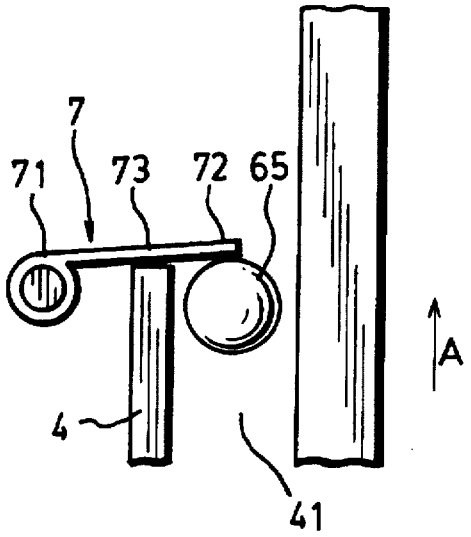
FIGS. 4(*a*) to 4(*d*) are schematic views illustrating movement of a game ball from a ball guide zone to a game zone of a game board of the first preferred embodiment.
Figure 4B:
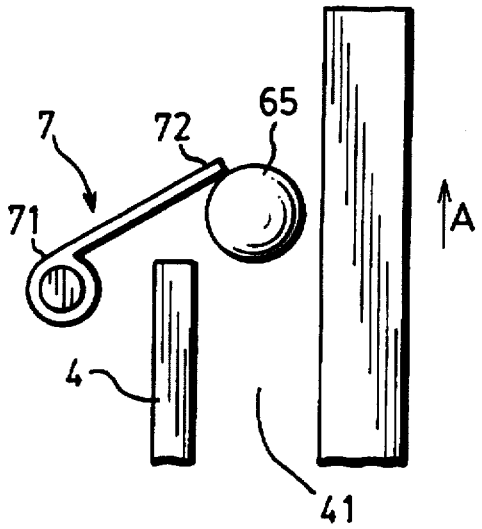
Figure 4C:
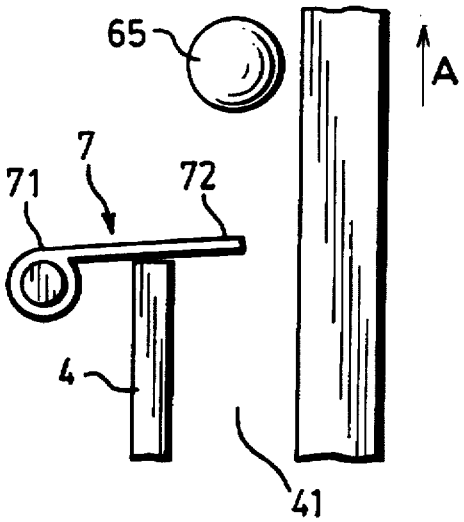
Figure 4D:
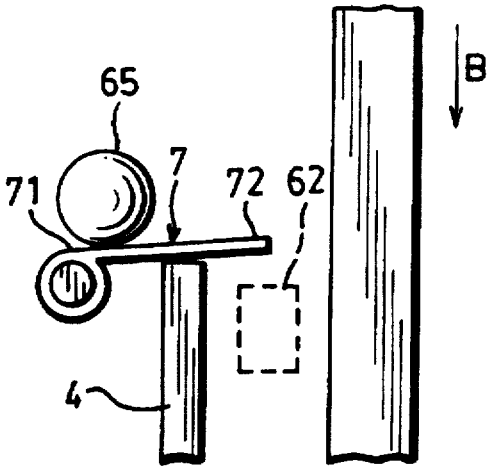

Referring to FIG. 3, the ball-shooting game machine further comprises a magnetic ball shooter 6. As illustrated, the magnetic ball shooter 6 is disposed behind the game board 1 and includes a permanent magnet 62 disposed adjacent to the ball guide zone 41 and a drive assembly for moving the permanent magnet 62 between a first position adjacent to a lowermost portion 410 of the ball guide zone 41, and a second position adjacent to an uppermost portion 411 of the ball guide zone 41. The drive assembly includes a drive belt unit 61 which extends between the upper and lower edges of the game board 1 and which is disposed adjacent to the ball guide zone 41. The permanent magnet 62 is secured to the drive belt unit 61 by means of a positioning member 63 on the latter. As such, the permanent magnet 62 can be disposed between the game board 1 and the drive belt unit 61. The drive assembly further includes a second bidirectional motor 600 coupled to the drive belt unit 61 for driving the drive belt unit 61 to reciprocate in a first direction, indicated by the arrow (A), and a second direction, indicated by the arrow (B). Due to magnetic attraction between the permanent magnet 62 and the game ball 65 in the ball guide zone 41, movement of the permanent magnet 62 from the first position to the second position will result in corresponding movement of the game ball 65 from the lowermost portion 410 to the uppermost portion 411 of the ball guide zone 41.

The magnetic ball shooter 6 further includes a lower sensor 641 disposed adjacent to the first position for generating a first position signal when the permanent magnet 62 is at the first position, and an upper sensor 642 disposed adjacent to the second position for generating a second position signal when the permanent magnet 62 is at the second position.

As shown in FIGS. 3 and 4(*a*), the game board 1 is further provided with a pivotable guard plate 7 which is disposed at the distal upper end of the partition member 4. In this embodiment, the guard plate 7 has a pivot end 71 mounted pivotally on the game board 1 in the game zone 40, a free end 72 which extends horizontally into the ball guide zone 41, and an intermediate section 73 which rests on the distal upper end of the partition member 4. As the game ball 65 moves to the uppermost portion of the ball guide zone 41 in the direction indicated by the arrow (A), the game ball 65 eventually abuts against the bottom side of the free end 72 of the guard plate 7 and causes the guard plate 7 to pivot away from the partition member 4, as best shown in FIG. 4(*b*). When the game ball 65 reaches the uppermost portion of the ball guide zone 41, the game ball 65 ceases to abut against the free end 72 of the guard plate 7. Thus, the guard plate 7 pivots back toward the partition member 4 by virtue of gravity, as shown in FIG. 4(*c*).

Referring to FIG. 4(*d*), when the permanent magnet 62 moves from the second position back to the first position in the direction indicated by the arrow (B), the game ball 65 moves downwardly therewith until the game ball 65 abuts against the top side of the free end 72 of the guard plate 7. At this time, the guard plate 7 prevents the game ball 65 from returning into the game ball zone 41. Due to continued movement of the permanent magnet 62 in the direction (B), the magnetic attraction between the game ball 65 and the permanent magnet 62 diminishes, thereby enabling the game ball 65 to slide along the guard plate 7 and fall into the game zone 40. Referring once more to FIG. 1, the front side of the game board 1 is further provided with a cliff member 75 which is disposed in the game zone 40 adjacent to the pivot end of the guard plate 7 for guiding movement of the game ball 65 from the guard plate 7 into the game zone 40 to ensure that the game ball 65 falls into the rotary disk set 2.

Figure 5:
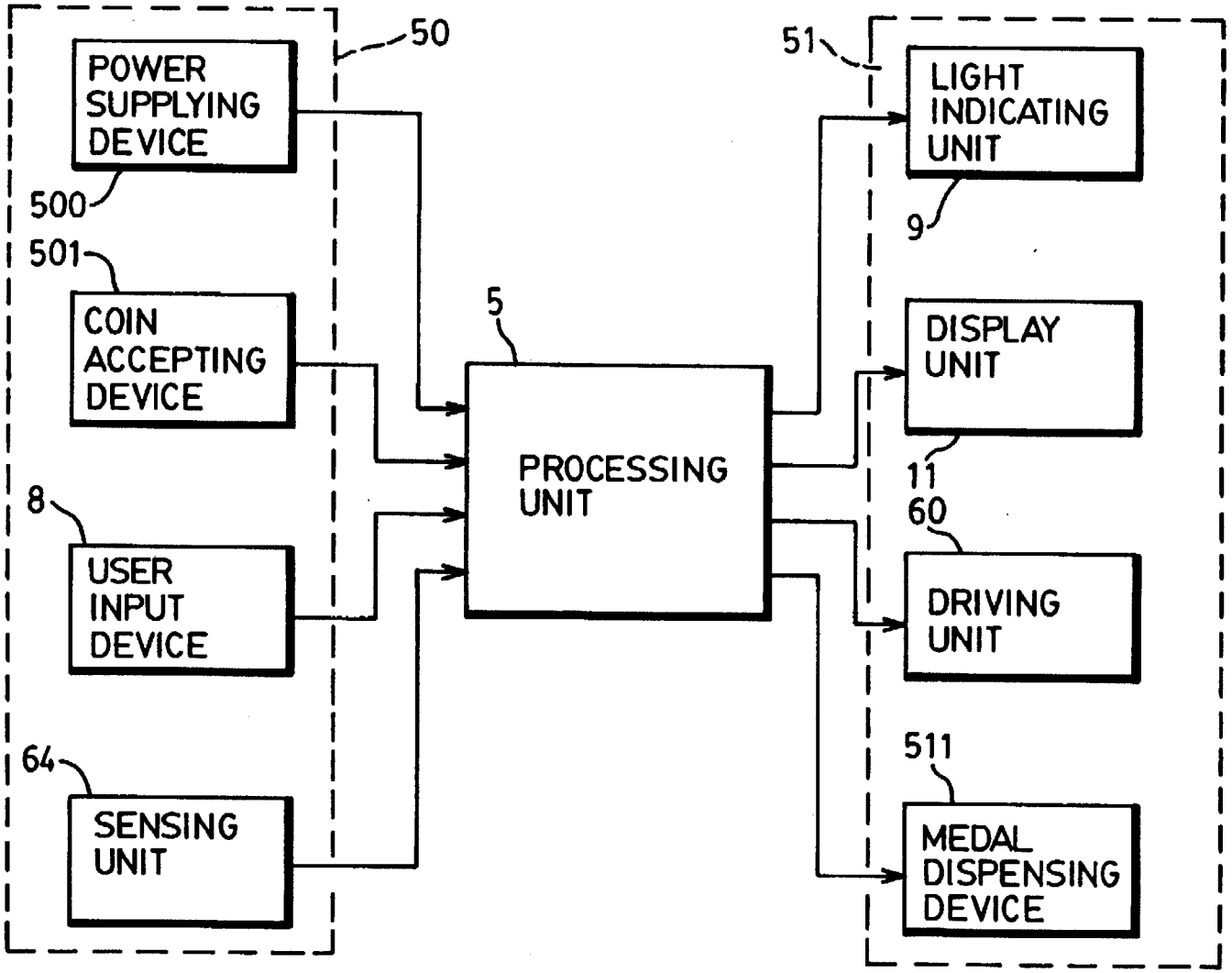
FIG. 5 is a schematic circuit block diagram of the first preferred embodiment.

FIG. 5 is a schematic circuit block diagram of the ball-shooting game machine. As illustrated, the ball-shooting game machine further comprises a processor unit 5 and input and output units 50, 51 coupled electrically to the processor unit 5. The input unit 50 includes a power supplying device 500, a coin accepting device 501, a user input device 8 and a sensing unit 64. The sensing unit 64 includes the lower and upper sensors 641, 642 (see FIG. 3). The output unit 51 includes a light indicating unit 9, a display unit 11, a driving unit 60 constituted by the first and second bidirectional motors 601, 600. (see FIGS. 2 and 3), and a medal dispensing device 511.

Referring to FIGS. 1, 3 and 5, the user input device 8 includes a start button 81 which is mounted on the machine frame (M) and which is operated so as to generate a start signal to be received by the processor unit 5. Upon reception of the start signal, the processor unit 5 controls the second bidirectional motor 600 to drive the drive belt unit 61 so as to move the permanent magnet 62 in the direction indicated by the arrow (A). When the permanent magnet 62 reaches the second position, the upper sensor 642 generates the second position signal. Upon reception of the second position signal, the processor unit 5 controls the second bidirectional motor 600 to drive the drive belt unit 61 in the opposite direction, thereby moving the permanent magnet 62 in the direction indicated by the arrow (B) (see FIG. 3). When the permanent magnet 62 reaches the first position, the lower sensor 641 generates the first position signal which is received by the processor unit 5. The processor unit 5 deactivates the second bidirectional motor 600 at this time.

The processor unit 5 also activates the first bidirectional motor 601 when the start button 81 is operated. The user input device 8 further includes a direction control button 80 which is similarly mounted on the machine frame (M) and which is operated so as to generate a direction signal to be received by the processor unit 5. Upon reception of the direction signal, the processor unit 5 controls the second bidirectional motor 601 so that the drive shaft 602 rotates in the opposite direction. Thus, operation of the direction control button 80 enables the user to change the position of the deflection pins 23 at the moment the game ball 65 enters the game zone 40.

Figure 6:
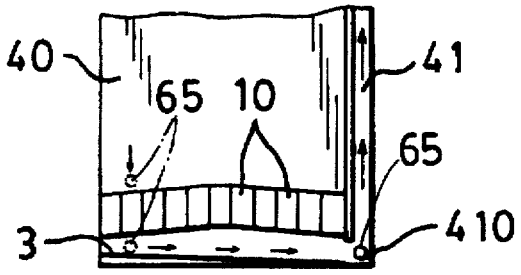
FIG. 6 illustrates how the game ball is returned from the game zone to the ball guide zone according to the first preferred embodiment.

A plurality of scoring slots 10 are disposed in the game zone 40 between the ball return guide 3 and the rotary disk set 2. In this embodiment, the scoring slots 10 are marked with the Arabic numbers 1 to 9. As shown in FIG. 6, after passing through the rotary disk set 2, the game ball 65 falls into one of the scoring slots 10 before being guided by the ball return guide 3 back into the lowermost portion 410 of the ball guide zone 41.

Referring again to FIG. 1, the light indicating unit 9 includes first and second light indicator sets 90, 91. The first light indicator set 90 includes a plurality of light indicators 900, each of which is disposed in a respective one of the scoring slots 10. The sensing unit 64 (see FIG. 5) further includes a ball sensing device (not shown) associated operably with the scoring slots 10 for generating a slot signal to be received by the processor unit 5 so as to inform the latter which one of the scoring slots 10 did the game ball 65 fall through. As such, the processor unit 5 is capable of activating the light indicator 900 that corresponds to said one of the scoring slots 10 upon reception of the slot signal from the sensing unit 64.

The second light indicator set 91 is mounted on the front side of the game board 1 at the upper edge of the same and similarly includes a plurality of light indicators 910 which correspond to the scoring slots 10, respectively. When power is supplied to the processor unit 5 by activating the power supplying device 500 (see FIG. 5), the processor unit 5 initially activates all of the light indicators 910. However, upon reception of a slot signal from the sensing unit 64, the processor unit 5 only activates the light indicator 910 which corresponds to the scoring slot 10 through which the game ball 5 fell through.

Referring again to FIGS. 1 and 5, the display unit 11 is mounted on the machine frame (M) adjacent to the user input device 8 and includes a credit display 110 and a points display 111. When coins are inserted into the coin accepting device 501, a credit signal corresponding to the total value of the inserted coins is received by the processor unit 5, thereby enabling the latter to display a credit number on the credit display 110 corresponding to the credit signal. The credit number is reduced each time the start button 81 is operated. In addition, each time the processor unit 5 receives a slot signal from the sensing unit 64, the processor unit 5 generates a points value corresponding to the received slot signal. The points value may be cumulative and is displayed by the processor unit 5 on the points display 111.

The medal dispensing device 511 is mounted in the machine frame (M) adjacent to a dispensing slot 12 on the latter. The user input device 8 further includes a dispensing button 82 which is mounted on the machine frame (M) and which is operable so as to generate a dispensing signal to be received by the processor unit 5. Upon reception of the dispensing signal, the processor unit 5 controls the medal dispensing device 511 to provide a medal output which corresponds to the points value on the points display 11 and which is supplied to the user via the dispensing slot 12. The points value may be reset at this time.

Since the structural and operational relationships among the display unit 11, the processor unit 5, the coin accepting device 501, the medal dispensing device 511 and the user input device 8 are known in the art, a detailed description of the same will not be provided herein.

Figure 7:
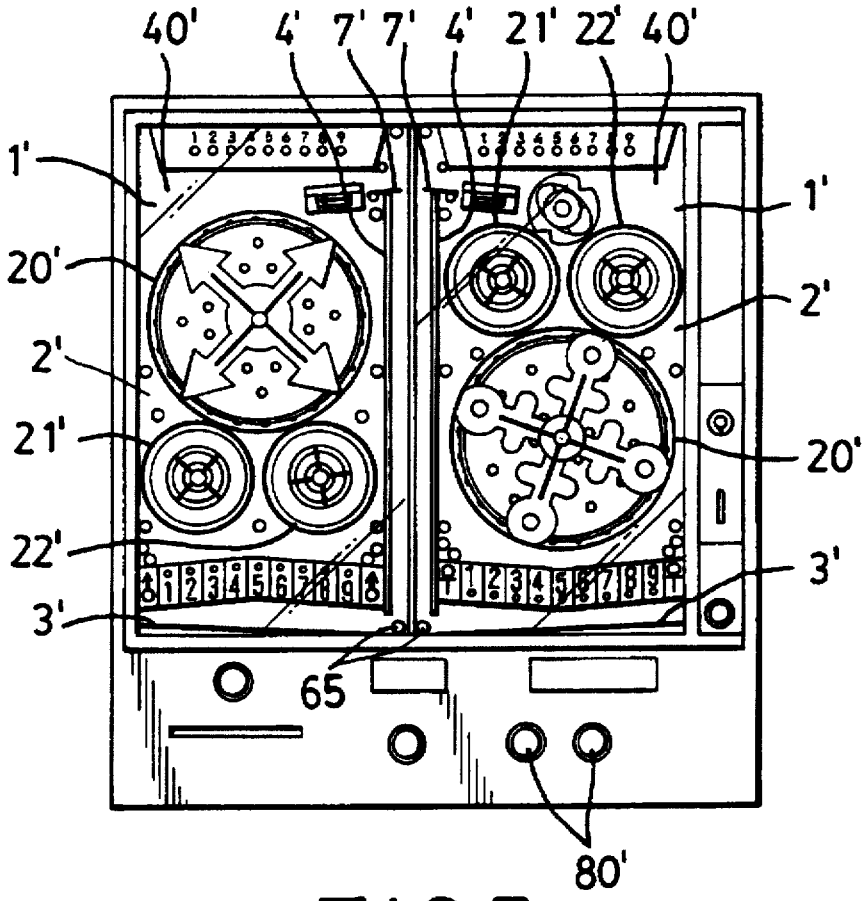
FIG. 7 is a schematic view of the second preferred embodiment of a ball-shooting game machine according to the present invention.

FIG. 7 illustrates the second preferred embodiment of a ball-shooting game machine according to the present invention. As shown, the second preferred embodiment comprises two vertical game boards 1'. Each game board 1' has a front side with a vertical partition member 4' mounted thereon for dividing the game board 1' into a game zone 40' and a ball guide zone 41', and an elongated ball return guide 3' which inclines downwardly from the game zone 40' to the ball guide zone 41' and which serves to guide a game ball 65 from the game zone 40' back to the ball guide zone 41'. Each game board 1' is further provided with a respective rotary disk set 2' and a respective pivotable guard plate 7'. In one of the game boards 1', the first and second driven disks 21', 22' of the rotary disk set 2' are located above the main rotary disk 20'. In the other one of the game boards 1', the first and second driven disks 21' 22' of the rotary disk set 2' are located below the main rotary disk 20'. Since the ball guide zones 41' of the game boards 1' are adjacent to one another, both game boards 1' may share a common magnetic ball shooter and a common processor unit (not shown). The ball-shooting game machine further includes two direction control buttons 80' for controlling the rotations of the rotary disk sets 2', respectively. Thus, the second preferred embodiment permits playing of two games simultaneously.

The advantages of the ball-shooting game machine of the present invention are as follows:

1. Unlike the spring-loaded ball shooter of the prior art, the magnetic ball shooter employed in the present invention does not suffer from spring fatigue, thereby resulting in a longer service life.

2. Because the deflection pins are installed on the rotary disk set, which rotate relative to the game board, randomness of the game ball movement can be enhanced.

3. The ball-shooting game machine of this invention is simple in construction and can be formed into a relatively small size. Thus, the present invention, which can be placed on a table or hung on a wall, is suitable for installation in small places.

4. The present invention can be further modified so as to be operable via remote control.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A ball-shooting game machine, comprising:

a vertical game board having a front side with a vertical partition member mounted thereon for dividing said game board into a game zone and a ball guide zone, said game board having upper and lower edges, said partition member having a distal upper end which is spaced from said upper edge of said game board;

a metal game ball disposed on said front side of said game board;

a magnetic ball shooter disposed behind said game board and including a magnet disposed adjacent to said ball guide zone, and a drive assembly for moving said magnet between a first position adjacent to a lowermost portion of said ball guide zone, and a second position adjacent to an uppermost portion of said ball guide zone, said magnet attracting magnetically with said game ball when said game ball is in said ball guide zone such that movement of said magnet from said first position to said second position will result in corresponding movement of said game ball from said lowermost portion to said uppermost portion of said ball guide zone; and a pivotable guard plate disposed at said upper end of said partition member, said guard plate having a pivot end mounted pivotally on said game board and a free end which extends horizontally into said ball guide zone, said game ball abutting against said guard plate and causing said guard plate to pivot upwardly when said game ball moves along with said magnet toward said uppermost portion of said ball guide zone, said guard plate preventing said game ball from returning into said game ball zone to cause separation of said game ball from said magnet and to permit said game ball to slide along said guard plate and fall into said game zone when said magnet is moved by said drive assembly from said second position back to said first position.

2. The ball-game shooting machine as claimed in claim 1, wherein said pivot end of said guard plate is disposed in said game zone, said guard plate further having an intermediate section which rests on said upper end of said partition member.

3. The ball-shooting game machine as claimed in claim 1, wherein said drive assembly comprises:

a drive belt unit extending between said upper and lower edges of said game board and disposed adjacent to said ball guide zone, said magnet being secured to said drive belt unit and being disposed between said game board and said drive belt unit;

bidirectional motor means, coupled to said drive belt unit, for driving said drive belt unit to move said magnet between said first and second positions.

4. The ball-shooting game machine as claimed in claim 3, further comprising:

a lower sensor for generating a first position signal when said magnet is at said first position;

an upper sensor for generating a second position signal when said magnet is at said second position; and a processor unit connected electrically to said bidirectional motor means and to said lower and upper sensors, said processor unit being capable of being activated so as to activate in turn said bidirectional motor means to drive said drive belt unit and move said magnet from said first position to said second position, said processor unit controlling said bidirectional motor means to drive said drive belt unit and move said magnet from said second position to said first position upon reception of said second position signal from said upper sensor, said processor unit deactivating said bidirectional motor means upon reception of said first position signal from said lower sensor.

5. The ball-shooting game machine as claimed in claim 1, further comprising a rotary disk set mounted rotatably on said front side of said game board in said game zone, and driving means for driving rotatably said rotary disk set, said rotary disk set including a main rotary disk which is coupled to said driving means and which has a rear side provided with a plurality of deflection pins that extend toward said game board for interfering with falling movement of said game ball in said game zone.

6. The ball-shooting game machine as claimed in claim 5, wherein said rotary disk set further comprises at least one driven disk which is driven rotatably by said main rotary disk and which has a rear side provided with a plurality of deflection pins that extend toward said game board for interfering with falling movement of said game ball in said game zone.

7. The ball-shooting game machine as claimed in claim 5, wherein said driving means comprises a bidirectional motor for driving rotatably said main rotary disk, and user input means connected electrically to said bidirectional motor for controlling direction of rotation of said main rotary disk.

8. The ball-shooting game machine as claimed in claim 5, wherein said front side of said game board is further provided with a cliff member which is disposed in said game zone adjacent to said guard plate for guiding movement of said game ball from said guard plate into said game zone to ensure that said game ball falls into said rotary disk set.

9. The ball-shooting game machine as claimed in claim 5, wherein said partition member has a distal lower end which is spaced from said lower edge of said game board, said front side of said game board being further provided with an elongated ball return guide which is disposed horizontally at said lower edge of said game board and which inclines downwardly from said game zone to said ball guide zone so as to guide said game ball from said game zone back to said ball guide zone via said lower end of said partition member.

10. The ball-shooting game machine as claimed in claim 9, wherein said game board is provided with a plurality of scoring slots disposed in said game zone between said ball return guide and said rotary disk set.

* * * * *